US006262130B1

(12) United States Patent
Derian et al.

(10) Patent No.: US 6,262,130 B1
(45) Date of Patent: Jul. 17, 2001

(54) HIGH SOLIDS, PUMPABLE AQUEOUS COMPOSITIONS OF HIGH MONOALKYL PHOSPHATE ESTER SALT CONTENT

(75) Inventors: Paul-Joel Derian, Plainsboro; Tao Gao, Monmouth Junction; Pascal Jean-Claude Herve, West Windsor; Robert Lee Reierson, Princeton Junction, all of NJ (US)

(73) Assignee: Rhodia, Inc., Cranbury, NJ (US)

( * ) Notice: Subject to any disclaimer, the term of this patent is extended or adjusted under 35 U.S.C. 154(b) by 0 days.

(21) Appl. No.: 09/447,366

(22) Filed: Nov. 23, 1999

Related U.S. Application Data

(60) Provisional application No. 60/109,639, filed on Nov. 24, 1998.

(51) Int. Cl.[7] ..... B01F 17/14; B01F 3/08; C11D 1/34

(52) U.S. Cl. ..... 516/56; 424/70.23; 510/436; 516/13; 516/907

(58) Field of Search ..... 516/13, 56, 907; 510/436; 424/70.23

(56) References Cited

U.S. PATENT DOCUMENTS

| | | | | |
|---|---|---|---|---|
| 2,656,372 | * | 10/1953 | Ernst et al. | 516/56 X |
| 4,139,485 | | 2/1979 | Imokawa et al. . | |
| 4,526,710 | * | 7/1985 | Fujisawa et al. | 510/436 X |
| 4,707,292 | * | 11/1987 | Sano et al. | 510/436 X |
| 4,753,754 | | 6/1988 | Messenger et al. | 510/436 X |
| 4,758,376 | * | 7/1988 | Hirota et al. | 510/436 X |
| 5,015,471 | * | 5/1991 | Birtwistle et al. | 510/436 X |
| 5,139,781 | | 8/1992 | Birtwistle et al. | 424/401 |
| 5,395,542 | * | 3/1995 | Nozaki et al. | 510/436 X |
| 5,463,101 | | 10/1995 | Reierson | 558/110 |
| 5,550,274 | | 8/1996 | Reierson | 558/110 |
| 5,554,781 | | 9/1996 | Reierson | 558/110 |
| 5,686,403 | * | 11/1997 | Matsumoto et al. | 510/436 |

FOREIGN PATENT DOCUMENTS

| | | | |
|---|---|---|---|
| 0442701A2 | 8/1991 | (EP) | A61K/7/075 |
| 675076A2 | 10/1995 | (EP) | C01B/25/24 |

OTHER PUBLICATIONS

Derwent WPI Abstract of JP 95015109 B2 issued Feb. 22, 1995, WPI Acc. No. 87–287444/198741.

* cited by examiner

*Primary Examiner*—Richard D. Lovering
(74) *Attorney, Agent, or Firm*—Ohlandt, Greeley, Ruggiero & Perle; George W. Rauchfuss

(57) ABSTRACT

Stable, pumpable aqueous surfactant compositions of water and alkyl phosphate ester salts having a molar ratio of mono- to di- alkyl phosphate esters equal to or greater than 80:20, with the surfactant composition being essentially free of water-soluble alcohol or co-solvent. The pumpable aqueous surfactant compositions have a solids content of about 40% by weight or more and exhibit one or more pumpable regions over a range of pH values for the aqueous surfactant composition.

20 Claims, No Drawings

HIGH SOLIDS, PUMPABLE AQUEOUS COMPOSITIONS OF HIGH MONOALKYL PHOSPHATE ESTER SALT CONTENT

This application claims priority for U.S. Provisional Application No. 60/109,639, filed Nov. 24, 1998.

FIELD OF THE INVENTION

This invention relates to novel, pumpable, concentrated aqueous surfactant compositions, particularly to surfactant compositions of alkyl phosphate ester salts. More particularly, this invention relates to readily pumpable, concentrated aqueous surfactant compositions of high solids content of alkyl phosphate ester salts having a high monoalkyl phosphate content.

BACKGROUND OF THE INVENTION

A wide variety of surfactants and mixtures of surfactants are known for many industrial, commercial and domestic applications. In these uses, there is often a need for the surfactant to be in a pumpable or fluid form for addition to formulations requiring the surfactant since such form enables one to save costs in handling and storing of the composition, as well as ease and convenience in formulating products therewith. Additionally, for numerous reasons, such as formulation flexibility, transportation and storage costs, it is desirable for the surfactant to be available in such pumpable compositions in as high a concentration or proportion of surfactant or active ingredient as possible.

The superior performance of fatty alcohol-based anionic phosphate esters of high monoalkyl phosphate ester content relative to dialkyl phosphate ester content, generally at a ratio of at least 80:20 or more, has long been recognized, especially for their mildness, detergency and foaming properties, and particularly for use in cosmetic or personal care products like shampoos, conditioners and body cleansers. See U.S. Pat. No. 4,139,485 to G. Imokawa et al., issued Feb. 13, 1979. Their usefulness in the latter products is due, at least in part, to their ability to produce high detergency with low skin irritancy compared to other surfactants, such as alkyl sulphates, alkyl ether sulphates, polyoxyethylene alkyl sulphates, alkyl benzene sulphonates and the like. Moreover, such fatty alcohol-based anionic phosphate ester surfactants of high monoalkyl ester content provide surfactants that evidence an excellent balance of properties. For example, as the monoalkyl phosphate content increases relative to the dialkyl phosphate content, the solubility, foaming ability and detergency increase. Additionally, the increase in monoalkyl phosphate content reduces the skin irritancy effect.

The ability to utilize surfactant compositions of high monoalkyl phosphate content in formulation of products has not been without difficulties. It is readily recognized that it is highly desirable that such surfactant compositions be high in active ingredient content, that is, have a high solids content of phosphate ester salts. However, in attempting to produce surfactant compositions of high concentration of phosphate ester salts, it was discovered that the compositions sometimes became rigid or immovable, non-flowable or non-pumpable gels rather than easily handled fluid solutions. Additionally, sometimes phase separation occurred when attempting to produce such high solid content phosphate ester salt surfactant compositions or during subsequent storage periods. In most instances it has been impossible to produce fluid or pumpable phosphate ester salt compositions above about 30 to 40% by weight active ingredient.

In order to address these drawbacks, various approaches have previously been employed. For example, it has been suggested to employ a mixture of different surfactants, such as, for example, as disclosed in U.S. Pat. Nos. 4,753,754 and 5,139,781. Another approach has been to formulate aqueous solutions of such surfactants with generally large amounts of alcohols or other co-solvents, such as propylene glycol, dipropylene glycol or ethanol, which act as thinners and solubilizing agents thereby lowering the viscosity of the solution and inhibiting the formation of a non-flowable gel. However, for preparation of many formulations, it is not desirable to employ surfactant mixtures; in fact, their use is to be avoided because they unnecessarily complicate the formulation process. Especially in cosmetic or personal care product formulations, there is a need, in numerous cases, to bar the use of alcohol or other co-solvent components in the formulations.

Moreover, other previously suggested approaches, such as to utilize alkanolamine salts of mono- or di- alkyl phosphates, or the co-use of alkyl sulfates or sulfonate salt surfactants has introduced other undesirable, irritating ingredients or reduces the desirable properties of the phosphate surfactants.

It is, therefore, desirable that surfactant compositions having high concentrations of alkyl phosphate salt surfactants in stable, pumpable liquid form be available that do not require the presence of such undesirable other surfactants or large amounts of co-solvents or alcohols and minimum amounts of adulterating additives, inactive or performance reducing components. It is further desirable that such surfactant compositions of high concentration of alkyl phosphate surfactants be available in aqueous form for use in cosmetic and personal care products.

A further object of this invention is to provide such stable, pumpable or flowable aqueous surfactant compositions that are pumpable at low temperatures. A further object of this invention is to provide a highly concentrated, pumpable or flowable alkyl phosphate salt surfactant composition, high in monoalkyl phosphate esters relative to dialkyl phosphate esters, that is transparent, preferably clear and colorless, is readily prepared and retains its good solubility, foamability and detergency properties and provides desirable foam density, stability and good skin feel properties. A still further object of this invention is to provide such highly concentrated aqueous surfactant compositions of essentially monoalkyl phosphate ester salts of low residual starting alcohol and phosphoric acid content.

Yet, another object of this invention is to provide such a stable, pumpable liquid surfactant composition with a maximum percent active concentration and a minimum amount of adulterating additives, inactive components or performance reducing components.

BRIEF SUMMARY OF THE INVENTION

This invention provides stable, pumpable or flowable aqueous alkyl phosphate ester salt surfactant compositions with a molar ratio of mono- to di- alkyl phosphate ester of equal to or greater than 80:20 and having a solids content of about 40% by weight or more and that is essentially free of water-soluble alcohol or organic co-solvents. These novel surfactant compositions exhibit one or more pumpable or flowable regions over a range of pH values, especially over a range of pH values of the aqueous surfactant composition of from about pH 5 to about pH 10.

This invention also provides such stable, pumpable or flowable aqueous alkyl phosphate ester salt surfactant compositions wherein the alkyl phosphate ester salts comprise at least about 60% by weight of alkyl phosphate ester salts of $C_{12}$ or fewer carbon atom chain alcohols, particularly linear or branched chain aliphatic alcohols.

DETAILED DESCRIPTION AND PREFERRED EMBODIMENTS

The novel stable, pumpable aqueous surfactant compositions of alkyl phosphate ester salts high in monoalkyl phosphate content of this invention are especially useful in cosmetic and personal care products because of their foaming abundancy, detergency and non-irritating properties, as well as their desirable foam density, stability and skin feel properties. The pumpable surfactant compositions of this invention are essentially free of water-soluble alcohols, co-solvents or other non-desired surfactants.

Pumpable aqueous surfactant compositions of this invention are characterized by a low level of residual phosphoric acid and residual alcohol. Pumpable aqueous surfactant compositions of this invention are produced from alkyl phosphate ester compositions high in monoalkyl phosphates relative to dialkyl phosphates, i.e., a molar ratio of mono- to di- alkyl phosphate esters of equal to or greater than 80:20, preferably 90:10 or greater and more preferably greater than 95:5. The phosphate ester compositions of low residual phosphoric acid and residual alcohol content and high in monoalkyl phosphates used to produce the aqueous pumpable surfactant composition of this invention are produced by the process disclosed in U.S. Pat. Nos. 5,463,101, 5,550,274 and 5,554,781, as well as in EP Patent publication number EP 0 675,076 A2, especially as described in Example 18 of the EP publication.

The alkyl phosphate ester salts are prepared by stirring the appropriate alkyl phosphate esters, high in monoalkyl phosphate ester content, into a solution of an appropriate base. As examples of suitable base materials for producing the salts of the alkyl phosphate esters, there may be mentioned sodium, potassium, lithium, or ammonium hydroxides and amines, such as for example, triethanolamine (TEA) and 2-amino-2-methyl-1-propanol (AMP) and the like. The salts of the monoalkyl phosphate esters may be of any suitable base:acid molar ratio salts, such as 0.8, 1, 1.5, 1.7 salts and the like.

Alkyl phosphate esters employed in forming the pumpable aqueous surfactant compositions of this invention are preferably produced from alcohols or mixtures of alcohols typically found in natural oils, for example, coconut oils, carbon chain length of about $C_8$ to $C_{18}$. Blends of linear and branched, saturated and unsaturated alcohols are permissable but at least about 60% by weight, more preferably at least about 70% by weight, and most preferably, at least about 90% and even 99% by weight, of the blend should be alcohols having 12 or fewer carbon atom chains. These alcohols are employed in the phosphation processes described in the aforementioned three US Patents and the EP Patent publication. As examples of such alcohols, there may be mentioned octanol, decanol, dodecanol, tetradecanol, hexadecanol and octadecanol or mixtures of alcohols, such as a commercially available blend of a mixture of about 0.1% decanol, about 68.3% dodecanol, about 27.6% tetradecanol and about 4.9% hexadecanol. Preferably, the alkyl phosphate ester salts comprise salts of predominately $C_{10}$ to $C_{12}$ alcohols or $C_8$ to $C_{12}$ alcohols. Any suitable alcohol or mixture of alcohols may be employed so long as there is at least about 60% by weight $C_{12}$ or shorter carbon chain alcohol or alcohols in the alcohol reactant for the phosphation process.

Pumpable aqueous surfactant compositions of this invention have a mono- to di- alkyl phosphate molar ratio equal to or greater than 80:20 and have a solids content of about 40% by weight or more and exhibit one or more pumpable regions over a range of pH values for the aqueous surfactant composition, especially over the pH range of from about pH 5 to about pH 10. The pumpable compositions could be, for example, in a lamellar or micellar phase.

The residual phosphoric acid or residual alcohol content of the pumpable aqueous surfactant compositions of this invention will generally be less than 8% by weight, preferably less than 6% by weight, and more preferably less than 5% by weight of each residual component. Higher phosphoric acid content contributes to higher viscosity and salt content and the alcohols, having limited solubility in water, tend to separate or contribute haze to the solution.

Especially preferred are those pumpable aqueous surfactant compositions of this invention which are essentially transparent, more particularly are essentially clear, and even more preferably are essentially colorless when in their pumpable regions.

Pumpable aqueous surfactant compositions of this invention are characterized by being pumpable or flowable at low temperatures, for example, at temperatures of below 40° C., especially in the range of temperatures of from about 5° C. to about 40° C.

While the total solids content of the pumpable aqueous surfactant composition is at least about 40% by weight, it will generally be from about 40% to about 70% by weight alkyl phosphate ester salt.

The invention is illustrated by the following illustrative, but non-limiting, examples. All phosphate esters were prepared by phosphation of the selected alcohol or blend of alcohols in accordance with the processes described in European Patent publication EP 0 675,076 A2, particularly Example 18 thereof, with adjustment of reagent charges as appropriate for different alcohol molecular weights or intended ester product distributions.

EXAMPLE 1

Preparation of Dodecyl Phosphate

A pre-dried reactor was charged, under essentially anhydrous conditions of a dry nitrogen blanket, with 343.5 lb. dodecanol which was heated to 35° C. to melt and provide an easily stirrable liquid. Polyphosphoric acid, (115%), 111.3 lb., was then added to the stirred liquor with cooling to maintain the temperature below 45° C. Stirring was continued for 30 min. to assure a homogenous solution. Phosphoric anhydride powder, 40.0 lb., was then added with cooling to maintain the temperature under 55° C. and the rapidly stirred mixture was heated to 80° C. and held at that temperature. Reaction progress was followed by the change in the second acid value and, after it had stabilized, 2.5 lb. water was added and stirring was continued at 80° C. for two hours. The batch was then cooled to 65° C., 1.0 lb. 35% hydrogen peroxide was added, the solution stirred for 30 minutes and readied for transfer. The product composition, determined by $^{31}P$, $^{13}C$ and $^{1}H$ nuclear magnetic resonance spectroscopy, was, by weight, 6.2% phosphoric acid, 76.0% mono(dodecyl) phosphate, 12.4% di(dodecyl) phosphate, 4.8% nonionics (residual alcohol) and 0.6% water (Karl-Fischer titration). Acid value 1 (first titration inflection point, pH~5.6) was 210.7 mg KOH/g sample.

EXAMPLE 2

Preparation of Aqueous, 42% Potassium Dodecyl Phosphate Solution

To a clean, dry reactor was sequentially charged 235.2 lb. potassium hydroxide solution (45%) and 397.5 lb. deionized water. The solution was heated to 60° C., which is above the melting point of the acid phosphate ester, and a 351.7 lb. portion of the molten product mixture from the above Example 1 was pumped into the stirred liquor with cooling to maintain the temperature at 60°–65° C. Stirring was continued for an hour to assure a uniform solution, the batch was cooled to below 50° C. and transferred to storage. The % solids determined on a Mettler LJ16 moisture analyzer (120° C., 120 min.) was 42 wt. % and the Karl-Fisher titration moisture was 58 wt. %. The pH of the clear, colorless solution was 8.20 and viscosity (@25° C.) was 50 cps. The theoretical % solids was calculated to be 43% and potassium/phosphorus (K/P) molar ratio, 1.43.

EXAMPLE 3

Preparation of Dodecyl Phosphate

By a procedure similar to Example 1, an additional lot of the monoalkyl enriched lauryl phosphate was prepared and the molten product mixture was flaked on a stainless steel belt flaker. The composition by weight was 6.6% phosphoric acid, 72.2% mono(dodecyl) phosphate, 13.0% di(dodecyl) phosphate, 6.5% non-ionics (dodecanol) and 1.7% water. Acid value 1 was 208.4 mg KOH/g sample.

EXAMPLE 4

Preparation of Aqueous, 61% Potassium Dodecyl Phosphate Solution

A 2 L, four-necked, round-bottomed flask equipped with an air motor driven Teflon paddle stirrer, thermocouple and condenser was charged with 457.40 g deionized water and 257.59 g 85% potassium hydroxide. The mixture was stirred until the pellets dissolved and the solution temperature stabilized at 60° C. in an oil bath. Remelted dodecyl phosphate from Example 3 was charged to a pressure equalizing addition funnel, warmed by a 250 watt heat lamp to prevent solidification, and 731.6 g was added over a 65 min. period during which the blend was heated to 82° C. Stirring was continued for another hour to guarantee a uniform composition, free from lumps. The product was bottled while hot.

The theoretical salt solids content was 61%, but the affinity for moisture made precise determination difficult; the Karl-Fischer moisture value was only 37%. The soft, pasty composition was diluted to a 50% solids solution and the pH determined to be 7.8 at a theoretical/potassium phosphorus molar ratio of 1.44.

EXAMPLE 5

Potassium Dodecyl Phosphate Solution with Higher K/P Ratio

In the same manner as for Example 4, 653.4 g dodecyl phosphate from Example 3 was added to 272.6 g potassium hydroxide (85%) in 817.2 g deionized water over a 70 min. period and temperature range of 64° to 84° C. The resulting 47% solids salt solution, potassium/phosphorus (K/P) molar ratio, 1.70, was allowed to cool to room temperature with continued stirring and was easily poured into receivers. The pH was 8.8.

EXAMPLE 6

Potassium Dodecyl Phosphate Solution with Stoichiometric K/P Ratio

In the same manner as for Example 4, 502.9 g dodecyl phosphate from Example 3 was added to 232.1 g potassium hydroxide solution (44.9 wt. %), diluted with an additional 595.2 g deionized water, over a 25 min. period and temperature range of from 61° to 81° C. The resulting potassium/phosphorus molar ratio of 0.99 was near the intended 1.00, stoichiometric ratio for the 43.1% salt solution and the pH of the modestly viscous, pearlescent liquid at room temperature was 6.0.

EXAMPLE 7

Potassium Dodecyl Phosphate Composition with Less than Stoichiometric K/P Ratio A laboratory batch of dodecyl phosphate was prepared by a process similar to Example 1, with a first acid value of 209.6 mg KOH/g sample and weight composition of 6.4% phosphoric acid, 72.3% mono(dodecyl) phosphate, 13.0% di(dodecyl) phosphate, 7.7% nonionics and 0.6% water. The equipment described in Example 4 was charged with 200.9g deionized water and 118.3g of the melted, acid dodecyl phosphate was poured into the stirred liquid to give a white, creamy, easily stirred composition. To this 35° C. lotion was added 59.9g potassium hydroxide solution (44.5 wt. %) to produce a 36% salt composition at 47° C. with a theoretical potassium/phosphorus molar ratio of 0.84. An additional 150.1g of the acid dodecyl phosphate was blended in followed by 66.4g of the 44.5% potassium hydroxide solution. The temperature reached a maximum of 52° within minutes, then began to drop. The creamy, easily stirred, uniform lotion was heated to 75° C. to try to melt it, but when no significant change was observed, it was allowed to cool to room temperature producing a stable, foamy, easily stirred, whipped cream like substance which was not further characterized. The calculated solids for the salt composition was 51% and potassium/phosphorus molar ratio was 0.78.

EXAMPLE 8

Monoalkyl Phosphate Enriched Ester Mixture from $C_{10}$–$C_{16}$ Alcohol Blend By a procedure similar to Example 1 but on a lab scale, 345.4 g phosphoric acid (115%) and 101.0 g phosphoric anhydride were added in turn to 1066.9 g of a partially fractionated natural blend of decyl to hexadecyl alcohols, hydroxyl no. 287, calculated average mol. wt., 195.49. Although the product distribution by weight has less meaning in this instance because of the mixed alcohol dialkyl phosphates, the resulting product composition calculated from the spectroscopic data was 6.1% phosphoric acid, 71.7% monoalkyl phosphates, 15.4% dialkyl phosphates, 6.2% nonionics and 0.6% water. The Acid Value 1, necessary for the calculation of the base charge in the salt preparation, was 206.1 mg KOH/g sample.

EXAMPLE 9

Potassium Salt Solution of $C_{10}$–$C_{16}$ Phosphate Ester Blend

By the procedure of Example 4, 100.13 g of the phosphate ester blend from Example 8 was added to 24.24 g potassium phosphate (85%) in 192.42 g deionized water at 60°–65° C. The resulting moderate viscosity, foamy, white composition was bottled while warm. The pH of the resulting 36% solids salt solution, potassium/phosphorus molar ratio of 1.00, was 6.4.

EXAMPLE 10

The 36% solids composition from Example 9 was put in an oven with a constant temperature of 80° C. to evaporate water until the final concentration of solids of this potassium salt alkyl phosphate solution with mixed $C_{10-16}$ carbon chain alcohols was 42.5%. The pH value of the sample was pH 6.2. Addition of 45% KOH solution into the 42.5% solids sample was conducted to adjust the pH value to pH 6.5, 7.0, 8.0, 8.5 and 9.0, respectively, and the solution appearance and phase structure was observed. The observations were as follows:

| pH | 6.5 | 7.0 | 8.0 | 8.5 | 9.0 |
|---|---|---|---|---|---|
| Solution appearance | Flowable lamellar phase | Flowable lamellar phase | Cloudy, low viscosity liquid | Cloudy, viscous solution | Cloudy viscous solution |

The solutions were flowable or pumpable at all of these pH values at room temperature.

EXAMPLE 11

The 61% solids composition of Example 4 was diluted with deionized water to make the final concentration of the potassium dodecyl phosphate solution 45% solids. The pH of this sample was 7.8. Addition of 45% potassium hydroxide solution or 50% citric acid solution to this sample was conducted to adjust the pH value to pH 6.5, 8.0, 8.5 and 9.0, respectively, and the solution appearance and phase structure observed. The observations were as follows:

| pH | 6.5 | 8.0 | 8.5 | 9.0 |
|---|---|---|---|---|
| Solution appearance | Flowable lamellar phase | Clear, micellar solution | Clear, micellar solution | Clear, micellar solution |

These solutions similarly were flowable or pumpable at room temperature.

EXAMPLE 12

The 61% composition of Example 4 was diluted with deionized water to make the final concentration of the potassium dodecyl phosphate solution 50% solids. The pH of this sample was 7.8. Addition of 45% KOH solution or 50% citric acid solution to this sample was conducted to adjust the pH value to pH 6.5, 7.0 and 8.5, respectively, and the solution appearance and phase structure observed. The observations were as follows:

| pH | 6.5 | 7.0 | 8.5 |
|---|---|---|---|
| Solution appearance | Viscous, lamellar phase | Viscous, lamellar phase | Clear, micellar/ lamellar solution |

These solutions were flowable or pumpable at room temperature.

With the foregoing description of the invention, those skilled in the art will appreciate that modifications may be made to the invention without departing from the spirit thereof. Therefore, it is not intended that the scope of the invention be limited to the specific embodiments illustrated and described.

We claim:

1. A pumpable aqueous surfactant composition comprising water and a surfactant consisting of alkyl phosphate ester salts, with the molar ratio of mono- to di- alkyl phosphate ester being equal to or greater than 80:20, said composition being essentially free of water-soluble alcohol or cosolvent, having a solids content of about 40% by weight or more, and exhibiting one or more pumpable regions over a range of pH values for the aqueous surfactant composition.

2. An aqueous surfactant composition of claim 1, wherein the molar ratio of mono- to di- alkyl ester is equal to or greater than 90:10.

3. An aqueous surfactant composition of claim 1, wherein the salts are selected from the group consisting of sodium, potassium, lithium, ammonium and amine salts.

4. An aqueous surfactant composition of claim 1, which is flowable at a temperature between about 5° C. to 40° C.

5. An aqueous surfactant composition of claim 1, wherein the composition exhibits one or more pumpable regions over a range of pH values for the aqueous surfactant composition of from about pH 5 to about pH 10.

6. An aqueous surfactant composition of claim 5, wherein the molar ratio of mono- to di- alkyl ester is equal to or greater than 90:10.

7. An aqueous surfactant composition of claim 5, wherein the alkyl phosphate ester salts comprise at least about 60% by weight salts of alkyl phosphate esters of $C_{12}$ or fewer carbon chain aliphatic alcohols.

8. An aqueous surfactant composition of claim 7, wherein the salts are selected from the group consisting of sodium, potassium, lithium, ammonium and amine salts.

9. An aqueous surfactant composition of claim 7, which is flowable at a temperature between about 5° C. to 40° C.

10. An aqueous surfactant composition of claim 7, wherein the alkyl phosphate ester salts comprise at least 80% by weight salts of alkyl phosphate ester of predominately $C_{12}$ or fewer carbon chain aliphatic alcohols.

11. An aqueous surfactant composition of claim 10, wherein the aqueous surfactant composition is essentially transparent.

12. An aqueous surfactant composition of claim 10, wherein the aliphatic alcohol comprises predominately $C_{10}$ to $C_{12}$ linear or branched aliphatic alcohols.

13. An aqueous surfactant composition of claim 10, wherein the molar ratio of mono- to di- alkyl ester is equal to or greater than 90:10.

14. An aqueous surfactant composition of claim 10, wherein the aliphatic alcohol comprises about 99% $C_{12}$ alcohol.

15. An aqueous surfactant composition of claim 14, which is exhibiting one or more pumpable regions over a range of pH values for the aqueous surfactant composition of from about pH 5 to about pH 10 at a temperature of between about 5° C. and about 40° C. and is essentially transparent.

16. An aqueous surfactant composition of claim 15, which is essentially clear and exhibits at least two pumpable regions over the range of pH values of from about pH 5 to about pH 10.

17. An aqueous surfactant composition of claim 1, wherein the alkyl phosphate ester salts comprise at least about 60% by weight salts of alkyl phosphate esters of $C_{12}$ or fewer carbon chain aliphatic alcohols.

18. An aqueous surfactant composition of claim 17, wherein the aqueous surfactant composition is essentially transparent.

19. An aqueous surfactant composition of claim 17, wherein the composition has a pH of 7.5 or higher.

20. An aqueous surfactant composition of claim 17, wherein the aliphatic alcohol comprises predominately $C_8$ to $C_{12}$ linear or branched aliphatic alcohols.

* * * * *